United States Patent [19]

Marchetti

[11] Patent Number: 4,694,635

[45] Date of Patent: Sep. 22, 1987

[54] MACHINE FOR SEALING CARDBOARD BOXES OF CONSTANT WIDTH

[76] Inventor: Augusto Marchetti, Piazza Sicilia, 7, 20146 Milano, Italy

[21] Appl. No.: 807,018

[22] Filed: Dec. 9, 1985

[30] Foreign Application Priority Data

Dec. 17, 1984 [IT] Italy ..... 24084 A/84

[51] Int. Cl.[4] ..... B65B 7/16

[52] U.S. Cl. ..... 53/137; 53/387

[58] Field of Search ..... 53/137, 387, 374; 198/861.2, 861.6, 627, 628

[56] References Cited

U.S. PATENT DOCUMENTS 3,236,022 2/1966 Loveland et al. ..... 53/137 X
3,733,772 5/1973 Dichiara ..... 53/374 X
4,161,138 7/1979 Marchetti ..... 53/137 X
4,543,150 9/1985 Marchetti ..... 53/137 X
4,572,760 2/1986 Marchetti ..... 53/137 X

*Primary Examiner*—Horace M. Culver
*Attorney, Agent, or Firm*—Cushman, Darby & Cushman

[57] ABSTRACT

The machine comprises a bed which is a support and advancement table for cardboard boxes. Along opposite sides of the support table, there are arranged two belt pulling-units capable of engaging with the sides of the boxes to bring about their advancement during work. The inlet ends of the pulling units are fitted with sliding supports and distance adjusting devices while the outlet ends are fitted with sliding supports and motorization devices for the belts. The sliding supports of the outlet ends include forked plates with sliding shoes which embrace a transverse guide bar fixed to the bed.

4 Claims, 4 Drawing Figures

MACHINE FOR SEALING CARDBOARD BOXES OF CONSTANT WIDTH

BACKGROUND OF THE INVENTION

1. Field of the Invention

The present invention relates to a machine for sealing cardboard boxes of constant width.

2. Description of the Related Art

Known machines for sealing cardboard boxes of constant width but variable width when passing from one series of boxes to another comprise a bed which describes a table for support and advancement of the boxes, a pair of pulling units placed at an adjustable distance along opposite sides of said supporting table to achieve a pulling engagement with the sides of said boxes, a lower taping unit and an upper taping unit arranged in a raised position which is adjustable with respect to the supporting table in order to seal the tops of the boxes during their advancement along said supporting table.

In the aforesaid machines it is important to ensure correct engagement of the pulling units with the sides of the boxes at the beginning of, during and at the end of the working travel in such a manner as to provide continuous advancement of the boxes and at the same time avoid damage thereto.

This requires in addition to appropriate devices for adjustment of the distance between the two pulling units and equally appropriate motorization devices for the belts, an effectively sliding assembly of the pulling units on guides capable of shifting said belts in a limited manner from their normally parallel positions in the loading and unloading operations of the boxes, but without abandoning the correct orthogonal position with respect to the supporting table. With the first movement by creating a slight convergence of the belts while the boxes are being fed and a slight divergence when they are being unloaded actually facilitates introduction and unloading of the boxes, the second movement would compromise effective pulling engagement with the sides of the boxes and hence their correct advancement into the working area.

As concerns the inlet ends of the two pulling units it has proven beneficial to equip said ends with supports mounted on sleeves sliding on a transversal guide bar fixed to the bed and coupled elastically to nut screws engaged in threaded portions of a distance-adjustment screw which can be rotated by means of a control crank. The elastic coupling with the nut screws ensures the appropriate working pressure for each distance adjustment performed by means of the regulation screw and made possible by the sliding of the sleeves on the guide bar.

The outlet ends of the pulling unit are in turn fitted with supports mounted on sliding sleeves on one or two transverse guide bars fixed to the bed and receive motion for the belts from motorized shafts which pass through said supports and are connected to a drive motor through a system of chains and gears. Otherwise the two functions of motorization and guide are simultaneously ensured by motion transmitting bevel gear pairs constrained in their rotation but freely sliding on a rotating drive shaft. In either case the outlet ends of the pulling units follow the adjusting motion of the inlet ends and allow shifting of the belts with respect to their normally parallel position to facilitate feeding and unloading of the boxes.

SUMMARY OF THE INVENTION

This being the state of the art, the object of the present invention is to achieve a machine for sealing cardboard boxes of constant width which would provide a new and more advantageous system of support, and sliding guides for the outlet ends of the pulling units.

In accordance with the invention said object is achieved by a machine comprising a bed which describes a support and advancement table for the boxes and a pair of pulling units placed at an adjustable distance along opposite sides of said support table to achieve pulling engagement with the sides of the boxes, said pulling units having inlet ends fitted with sliding supports and distance adjusting devices and outlet ends fitted with sliding supports and motorization devices for the belts characterized in that said sliding supports of the outlet ends of the pulling units comprise forked plates with sliding shoes which embrace in a sliding manner a transverse guide bar fixed to the bed.

With devices quite simple to construct the present invention thus gives to the outlet ends of the pulling units a support and guide system which allows them approach movement and withdrawal movement when required, causing the belts to diverge during unloading of the boxes and at the same time avoiding the undesired withdrawal of the belts from correct orthogonality with respect to the support table. The forked plates embrace the guide bar in such a manner as to prevent rotation of the pulling units from their orthogonal position.

BRIEF DESCRIPTION OF THE DRAWINGS

These and other characteristics of the present invention will be made clear by the following detailed description of a practical embodiment thereof illustrated as a nonlimiting example in the annexed drawings wherein.

DETAILED DESCRIPTION OF THE PREFERRED EMBODIMENT

Figure 1:
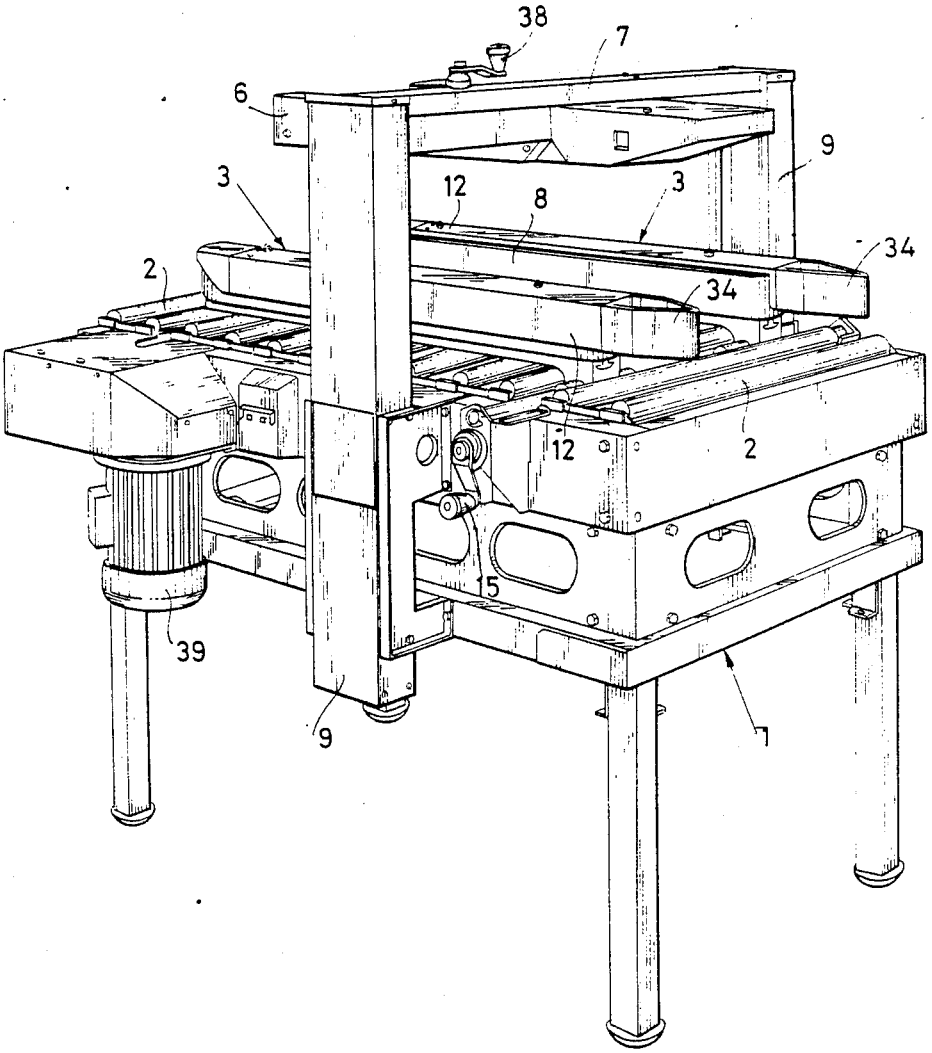
FIG. 1 shows a perspective view of the machine according to the invention.

The machine shown in the drawings comprises basically a bed 1 which with a series of idling rollers 2 describes a support and advancement table for the boxes to be sealed. A pair of pulling units 3 is arranged at an adjustable distance along opposite sides of the bed 1 in order to achieve a pulling engagement with the sides of the boxes. An optional lower taping unit (not shown) may be inserted and fixed in a recess 4 (FIG. 2) in said support table for the purpose of applying lengths of adhesive sealing tape along the bottom of the boxes. An upper taping unit 5 (FIG. 4) may in turn be attached to arms 6 of a cross-piece 7 placed in an adjustable raised position over the support table of the boxes along fixed support and guide columns 9 for the purpose of applying pieces of adhesive sealing tape along the tops of the boxes. A control crank 38 makes it possible to vary the position of the cross-piece 7 by means of a mechanism not shown in the drawings.

Figure 2:
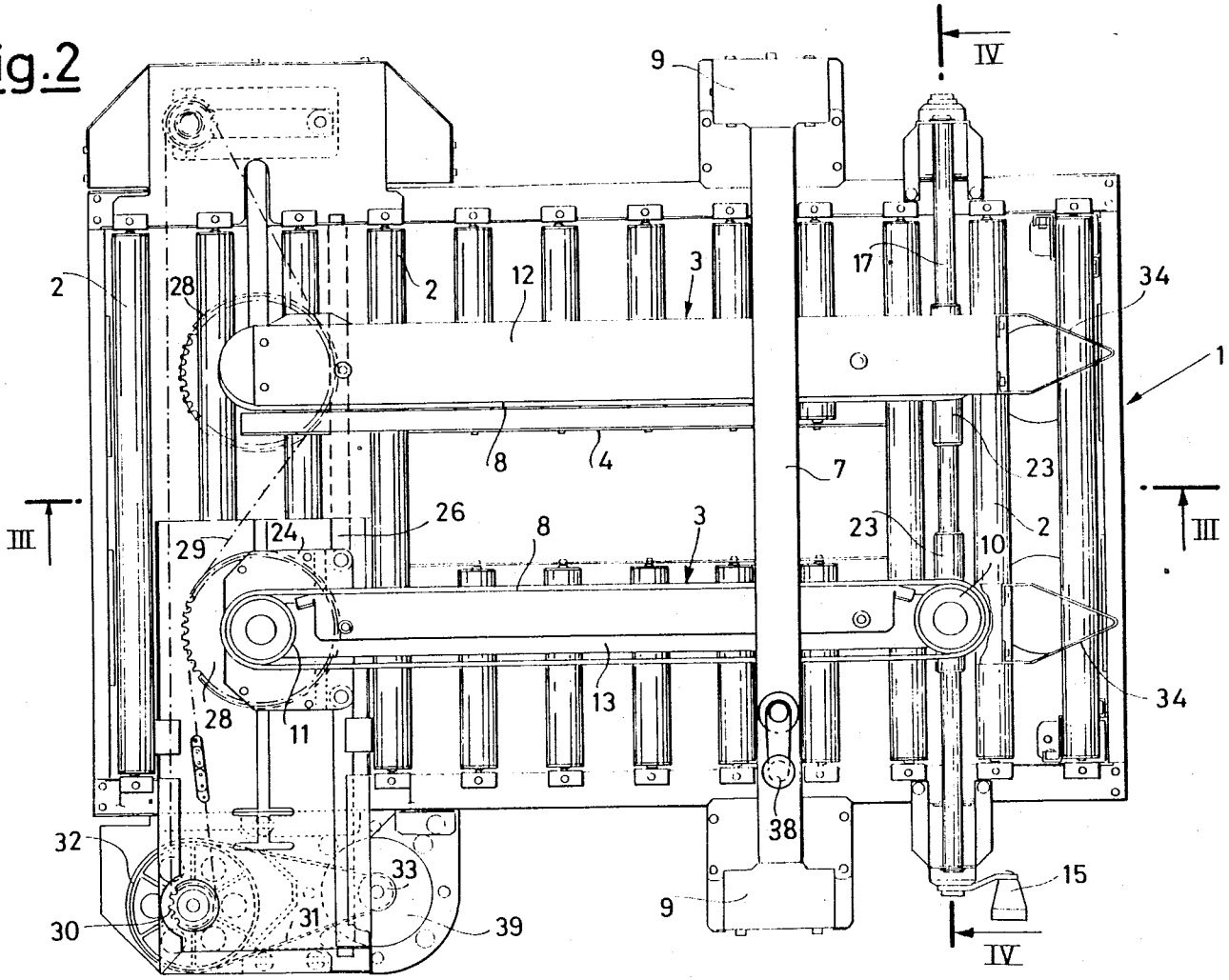
FIG. 2 shows said machine in a partially cutaway top view.
Figure 3:
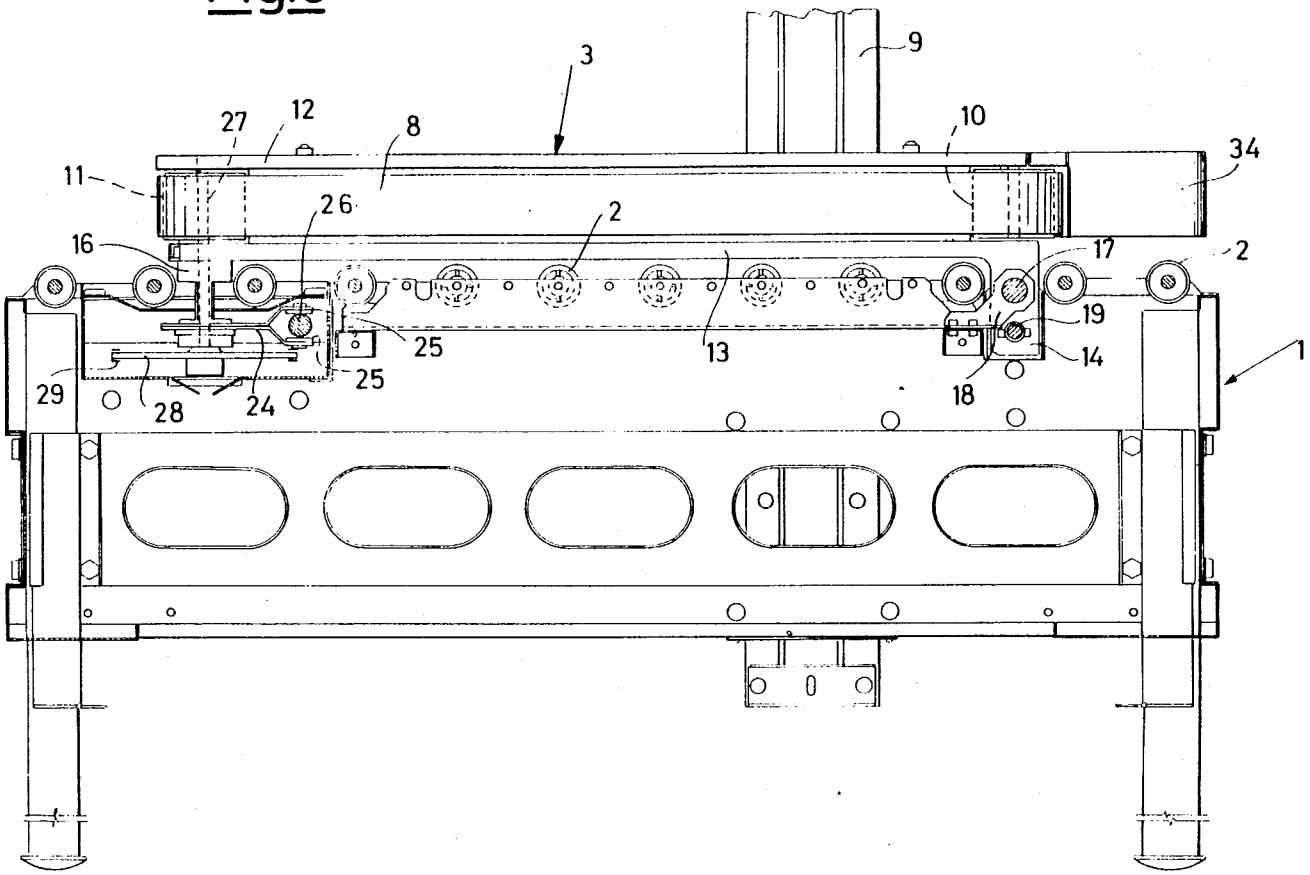
FIG. 3 shows said machine in longitudinal cross-section along plane of cut III—III of FIG. 2.
Figure 4:
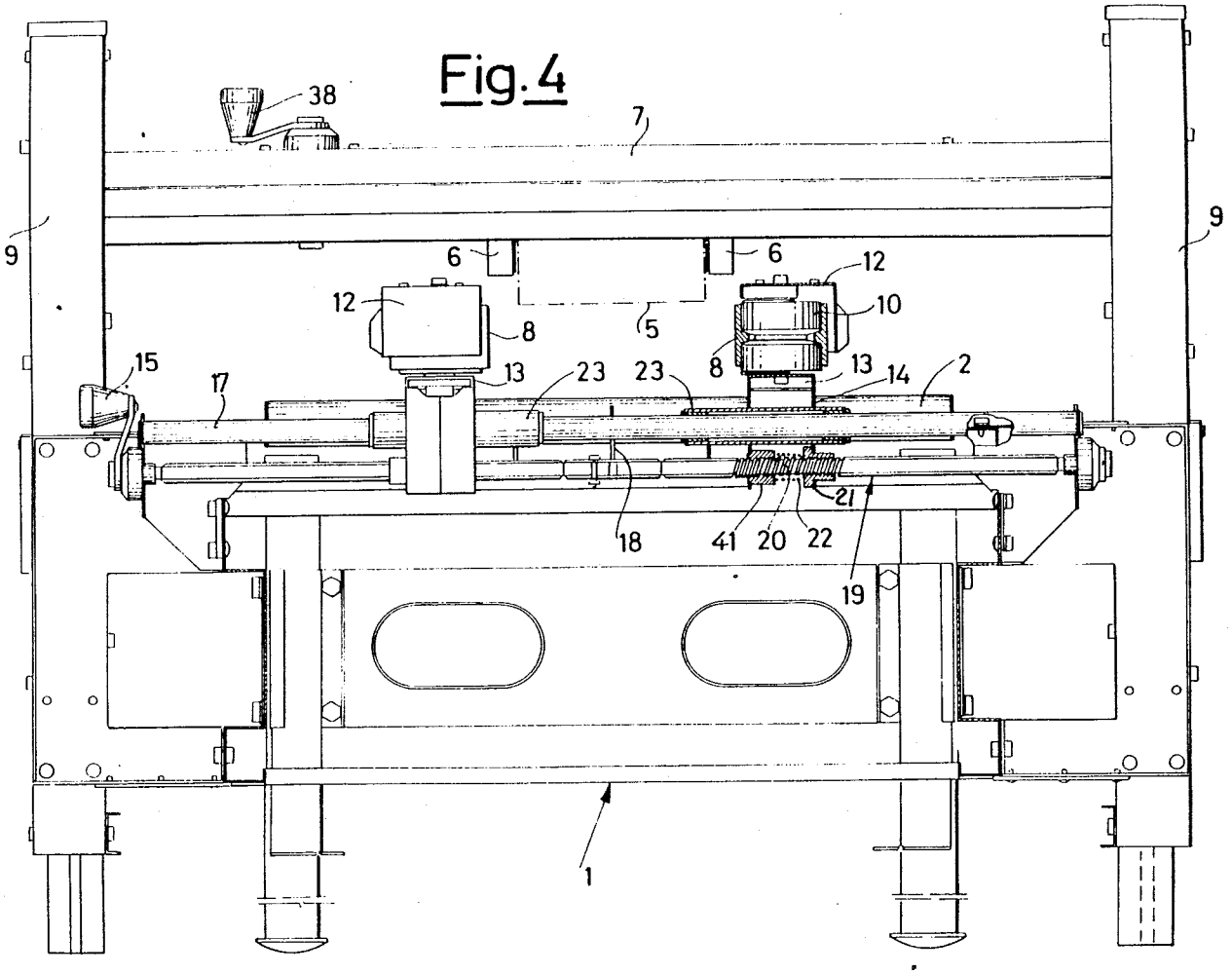
FIG. 4 shows said machine in cross section along plane of cut IV—IV of FIG. 2.

As shown in FIGS. 1–3, the pulling units 3 comprise belts 8 mounted between terminal pulleys 10 and 11 (FIGS. 2 and 3) of which the first is an idling pulley and the second is motorized with a motor 39 (FIGS. 1 and 2) and devices for transmission of motion which will be described below. A protective hood 12 covers the belts 8 above and on the outer side (FIG. 4). To support the pulleys 10 and 11 and the hood 12 there are longitudinal arms 13 which at the inlet and outlet ends respectively of the pulling units 3 extend downward with the supports 14 and 16 (FIG. 3), respectively.

The supports 14 of the inlet ends are fixed on sleeves 23 (FIGS. 2 and 4) mounted in a sliding manner on a transverse guide bar 17 fixed to the bed 1 at the ends and also secured centrally to said bed 1 by brackets 18 (FIGS. 3 and 4). Said supports 14 are also mounted in a sliding manner on a transverse screw threaded guide bar 19 having threaded portions 20 (FIG. 4) of opposite hand and with which are engaged nut screws 21 and sliding bushings 41 (FIG. 4) respectively. The supports 14 are engaged in the nut screws 21 and the sliding bushings 41 in such a manner as to prevent rotation of the supports 14. However, the supports 14 may still slide along the longitudinal axis of the screw threaded guide bar 19. Nut screws 21 and sliding bushings 41 are held at a minimal mutual distance from each other by springs 22. An operating crank 15 makes it possible to rotate the screw threaded guide bar 19 to cause mutual approach towards or withdrawal from the two supports 14, i.e. to adjust the distance between the pulling units (FIGS. 1–3) 3. This arrangement is a known system which therefore will not be described in further detail.

The supports 16 (FIG. 3) of the outlet ends of the pulling units 3 are in turn fixed to forked plates 24 fitted with diverging shoe portions 25 (FIG. 3) which embrace in a sliding manner a transverse guide bar 26 therebetween, thus guiding the sliding movement of the forked plates 24 along the longitudinal axis of the bar 26. The supports 16 and the forked plates 24 are fixedly mounted vertically against movement by rotatable shafts 27 which provide for rotation of the motorized pulleys. The shafts 27 (FIG. 3) receive motion from gears 28 which are in turn connected by a chain 29 to a drive gear 30 (FIG. 2) which is caused to rotate by the motor 39 through a chain 31 and two drive gears 32 and 33 (FIG. 2). This motorizaton system is also known.

Thanks to the sliding engagement of the supports 14 and 16 (FIG. 3) on the guide bars 17 and 26 and making use of such mobility of the supports 14 and 16 on the guide bars 17 and 26 and the type of engagement achieved by the forked plates 24, the pulling units 3 can follow the different adjustments brought about by the screw threaded guide bar 19 and at the same time make possible momentary shifting of the pulling units 3 from the usual parallel position in the loading and unloading steps of the boxes. More precisely, at the moment a box is introduced, after positioning thereof thanks to bevels 34 (FIGS. 1–3), the momentary mutual withdrawal of the inlet ends of the pulling units can be forced resulting in the arrangement of the latter in a converging position which facilitates engagement of the belts with the sides of the box and hence introduction of the box. Once introduction is completed the pulling units 3 return to the parallel position, thus accompanying the box during its working travel. At the moment of unloading while the outlet ends of the pulling units 3 are held in a spread position by the sides of the box the inlet pulling units can again draw together in the rest position so that the pulling units 3 arrange themselves momentarily in a diverging position which facilitates expulsion of the box.

I claim:

1. A machine for sealing cardboard boxes of constant width, comprising:

a support table for the boxes;

a pair of belt pulling units placed at an adjustable distance along opposite sides of the support table to achieve a pulling engagement with the sides of the boxes, said pulling units having inlet ends and outlet ends;

first sliding supports and adjustment means, fitted at the inlet ends of the pulling units, for adjusting the distance between the pulling units along opposite sides of the support table, said first sliding supports including a plurality of sliding bushings fixed thereto;

a first transverse guide bar fixed to the support table and arranged near the outlet ends of the pulling units;

second sliding supports and motorization means, fitted at the outlet ends of the pulling units, for operating the belt pulling units; and forked plates being secured at one end to the second sliding supports and having shoe means, formed at an opposite end, for embracing in a sliding manner with the first transverse guide bar.

2. The machine according to claim 1, wherein said motorization means include:

a motor;

a plurality of transmission gears;

chain means for connecting the gears to the motor; and a plurality of shaft means, fixed through the gears, for driving the belt pulling units.

3. The machine according to claim 1, wherein said adjustment means include:

a second transverse guide bar being arranged parallel to the first transverse guide bar and having threaded portions, said second transverse guide bar further being arranged near the inlet ends of the pulling units;

a plurality of nut screws secured to the first sliding supports fitted at the inlet ends of the pulling units and engaged with the threaded portions of the second transverse guide bar; and crank means, fixed at one end of the second transverse guide bar for turning said second guide bar so that the first sliding supports are caused to slide along the first and second guide bars due to the engagement of the plurality of nut screws with the threaded portions of the second guide bar.

4. The machine according to claim 3, wherein said adjustment means further includes elastic spring means, interposed between the plurality of nut screws and the plurality of sliding bushings, for keeping said nut screws and said sliding bushings spaced apart.

* * * * *